United States Patent [19]

Turner et al.

[11] 4,386,000

[45] May 31, 1983

[54] FABRIC SOFTENING COMPOSITION

[75] Inventors: John C. Turner, Cramlington; Anthony Dovey, Whitley Bay; Neil A. MacGilp, Morpeth, all of England

[73] Assignee: The Procter & Gamble Company, Cincinnati, Ohio

[21] Appl. No.: 279,367

[22] Filed: Jul. 1, 1981

[30] Foreign Application Priority Data

Jan. 7, 1980 [GB] United Kingdom ..... 8022104

[51] Int. Cl.[3] ..... D06M 13/46; D06M 15/52

[52] U.S. Cl. ..... 252/8.8; 524/94; 524/186

[58] Field of Search ..... 252/8.8; 524/94, 186

[56] References Cited

U.S. PATENT DOCUMENTS 3,681,241 8/1972 Rudy ..... 252/8.75
4,237,016 12/1980 Rudkin et al. ..... 252/8.8
4,326,965 4/1982 Lips et al. ..... 252/8.8

FOREIGN PATENT DOCUMENTS 13780 8/1980 European Pat. Off. .
6706178 11/1968 Netherlands .
1538094 1/1979 United Kingdom .

*Primary Examiner*—Maria Parrish Tungol

[57] ABSTRACT

A concentrated fabric softening composition comprising water-insoluble cationic softener and a viscosity control system comprising a first component selected from non-cyclic hydrocarbons, fatty acids and esters thereof and fatty alcohols, and a second component which is a water-soluble cationic polymer having a molecular weight of 2000 to 250,000, selected from polyethylenimine, ethoxylated and propoxylated polyethylenimines and quaternized polyethylenimines. The composition has improved viscosity and stability at both normal and elevated temperatures.

13 Claims, No Drawings

FABRIC SOFTENING COMPOSITION

TECHNICAL FIELD

This invention relates to fabric softening compositions. More particularly, it relates to fabric softening compositions in aqueous medium and containing a relatively high proportion of cationic fabric softener.

BACKGROUND

Conventional rinse-added fabric softening compositions contain fabric softening agents which are substantially water-insoluble cationic materials usually having two long alkyl chains. Typical of such materials are di-stearyl dimethyl ammonium chloride and imidazolinium compounds substituted with two stearyl groups. These materials are normally prepared in the form of an aqueous dispersion or emulsion, and it is generally not possible to prepare such aqueous dispersions with more than about 7% of cationic material, while still retaining acceptable viscosity and stability characteristics. This, of course, limits the level of softening performance achievable without using excessive amounts of product, and also adds substantially to the distribution and packaging costs, because of the need to market such dilute solutions of the active ingredient. Another advantage of a more concentrated fabric softening composition is that it permits the consumer to exercise choice in the type of performance desired, in that the concentrated product can either be used as such or can be diluted to a conventional concentration before use. This opens up the possibility of supplying the concentrated fabric softening composition in a more economically packaged form intended for making up by the consumer into a conventional bottle.

The problem of preparing fabric softening compositions in concentrated form suitable for consumer use has already been addressed in the art, but the various solutions proposed have not been entirely satisfactory. It is generally known (for example in U.S. Pat. No. 3,681,241) that the presence of ionizable salts in such compositions do help reduce viscosity, but these materials do not offer the additional benefit of enhancing the softening performance of the compositions. The use of certain special processing techniques has also been suggested in this regard (for example in U.S. Pat. No. 3,954,634) but again this does not provide a complete and satisfactory solution, and it is not an easy matter to adopt this type of process on a commercial scale. Dutch patent application No. 6706178 relates to viscosity control in fabric softening compositions with up to 12% of cationic softener, and suggests the use of low molecular weight hydrocarbons for this purpose. Finally, German patent application No. 25 03 026 discloses a complex softener/disinfectant composition in which a long chain fatty alcohol used at a relatively low ratio of cationic softener to alcohol is suggested as a solubilization aid.

In verbruggen European patent application No. 79200801.3, concentrated fabric softener compositions are disclosed which contain small amounts of certain hydrocarbon, fatty acid, fatty acid ester and fatty alcohol materials as viscosity reducing agents. It has been found, however, that although these materials are excellent in reducing the viscosity of concentrated fabric softener compositions at temperatures below the Krafft point of the cationic softener, they are very much less effective as viscosity reducing agents in concentrated compositions at temperatures close to or above the Krafft point of the softener. This means for instance, that in the case of distearyl dimethyl ammonium chloride cationic softener (Krafft point above 37° C.), compositional viscosity tends to increase markedly from about 30° upwards, so that at a temperature of about 40° C. compositions based thereon become virtually unpourable.

It has now been discovered that viscosity control in concentrated fabric softener compositions can be significantly improved both at normal and higher temperatures, by the use of a two-component viscosity regulator system comprising, firstly, a hydrophobic component selected from specified hydrocarbons, fatty acids, fatty acid esters and fatty alcohols, and secondly, a water-soluble cationic polymeric component of specified polymer molecular weight and chemical type.

The use of polymers in cationic fabric softener compositions is disclosed generally in European Published patent application No. 2085 which teaches the use of cationic polymers for minimizing the effect of surfactant carry-over from a machine wash cycle into the rinse. However, the patent application does not disclose the use of a combination of hydrophobic and cationic polymer materials as defined herein in concentrated fabric softener compositions, nor does it recognize the beneficial effect of this combination of materials in regulating the viscosity of concentrated fabric softener compositions.

The present invention thus provides a concentrated liquid fabric softener composition having improved viscosity characteristics at both normal and elevated temperatures and having good storage stability and other physical characteristics necessary for consumer use. The present invention also provides a cost-efficient, physically acceptable fabric softener composition providing softening benefits across the range of natural and synthetic fabric types, based on water-insoluble cationic softener as the major active component of the composition.

SUMMARY OF THE INVENTION

Accordingly, the present invention provides a liquid fabric softening composition in the form of a dispersion in aqueous isotropic medium characterized by:

(a) from about 8% to about 22% of water-insoluble cationic fabric softener, and (b) a viscosity regulator system comprising:

(i) from about 0.5% to about 6% of a first regulator component selected from $C_{10}$–$C_{24}$ non-cyclic hydrocarbons, $C_{10}$–$C_{24}$ fatty acids or esters thereof with monohydric alcohols containing from 1 to 4 carbon atoms, and $C_{10}$–$C_{24}$ fatty alcohols, and (ii) from about 0.05% to about 1.0% of a second regulator component which is a water-soluble cationic polymer having an average molecular weight in the range from about 2000 to about 250,000.

Preferably the cationic polymer contains an average of from about 100 to about 1000 monomer units per molecule, has a cationic charge density in the aqueous composition of at least 0.05 cations per monomer unit and is selected from polyethylenimine, the reaction product of polyethylenimine with ethylene oxide and/or propylene oxide in a weight ratio of greater than about 1:4, and the $C_1$–$C_{20}$ alkyl or benzyl quaternization products of polyethylenimine or of said reaction product of polyethylenimine with ethylene oxide and/or propylene oxide.

In preferred compositions, the cationic fabric softener has a Krafft point of less than about 45° C. at a concentration of about 8% and displays a lamellar crystalline phase at a temperature above the Krafft point of the softener. Preferably, the cationic fabric softener is:

(a) a di-$C_{12}$–$C_{24}$ alkyl or alkenyl mono- or polyammonium salt,
(b) a di-$C_{12}$–$C_{24}$ alkyl or alkenyl imidazolinium salt, or
(c) a mixture thereof.

A highly preferred cationic fabric softener is a mixture of di-$C_{12}$–$C_{24}$ alkyl or alkenyl imidazolinium salt and di-$C_{12}$–$C_{24}$ alkyl or alkenyl mono-ammonium salt in a weight ratio of at least about 1:1, preferably from about 1.5:1 to about 6:1 and at a total cationic softener level of from about 10% to about 20%, preferably from about 11% to about 18% by weight of the composition.

With regard to the viscosity regulator system, the first regulator component is preferably selected from $C_{14}$–$C_{22}$ linear or branched paraffins, $C_{10}$–$C_{20}$ fatty acids and $C_{12}$–$C_{16}$ fatty alcohols while the second regulator component preferably has an average molecular weight of from about 5000 to 150,000 contains on average from about 150 to about 700 monomer units per molecule, has a cationic charge density of at least about 0.15 cations per monomer unit and is selected from polyethylenimine, the reaction product of polyethylenimine with ethylene oxide at weight ratio of from about 1:1 to about 4:1 and $C_1$–$C_{20}$ alkyl or benzyl quaternization products of polyethylenimine. Desirably, the viscosity regulator system comprises from about 2% to about 5% of said first regulator component and from about 0.1% to about 0.5% of said second regulator component.

An optional, through preferred additional component of the instant compositions is a water-soluble cationic or nonionic surfactant or mixture thereof, the weight ratio of cationic fabric softener to water-soluble cationic or nonionic surfactant lying in the range from about 100:1 to about 5:2. Suitably, the water-soluble cationic surfactant can be:

(a) a mono-$C_8$–$C_{24}$ alkyl or alkenyl mono- or polyammonium salt,
(b) a mono-$C_8$–$C_{24}$ alkyl or alkenyl imidazolinium salt,
(c) a mono-$C_8$–$C_{24}$ alkyl or alkenyl pyridinium salt, or
(d) a mixture thereof.

The water-soluble cationic or nonionic surfactant is valuable, as described in European patent application No. 80200320.2, in enhancing the stability of the softener formulation.

The various ingredients of the composition of the invention will now be discussed in detail.

The water-insoluble cationic fabric softener can be any fabric-substantive cationic compound which, in pure form as a strong acid salt (e.g. chloride), has a solubility in distilled water at pH 2.5 and 20° C. of less than 1 g/l, or can be a mixture of such compounds. In this context, the soluble fraction of the surfactant is taken to be that material which cannot be separated from water by centrifugal action and which passes a 100 nm Nuclepore filter (Registered Trade Mark). In addition, the cationic softener desirably has a monomer solubility (as measured by critical micelle concentration or C.M.C.) such that the C.M.C. of the material under the conditions defined above is less than about 50 p.p.m., preferably less than about 20 p.p.m. Literature C.M.C. values are taken where possible, especially surface tension, conductimetric or dye adsorption values.

Preferred cationic softener materials are di-$C_{12}$–$C_{24}$ alkyl or alkenyl 'onium salts, especially mono- and polyammonium salts, and imidazolinium salts. Optionally, the two long chain alkyl or alkenyl groups may be substituted or interrupted by functional groups such as —OH, —O—, CONH—, —COO—, ethyleneoxy, propyleneoxy etc.

Well known species of substantially water-insoluble mono-ammonium compounds are the quaternary ammonium and amine salt compounds having the formula:

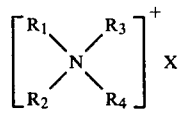

wherein $R_1$ and $R_2$ represent alkyl or alkenyl groups of from about 12 to about 24 carbon atoms optionally interrupted by amide, propyleneoxy groups etc. $R_3$ and $R_4$ represent hydrogen alkyl, alkenyl or hydroxyalkyl groups containing from 1 to about 4 carbon atoms; and X is the salt counteranion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride, di(coconut alkyl) dimethyl ammonium methosulfate; di(tallowyl amido)ethyl methyl ammonium chloride and di(tallowyl amido)ethyl ammonium methosulfate. Of these ditallow dimethyl ammonium chloride and di(hydrogenated tallow alkyl) dimethyl ammonium chloride are preferred.

Another preferred class of water-insoluble cationic materials are the alkyl imidazolinium salts believed to have the formula:

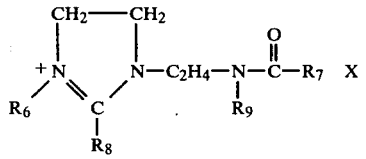

wherein $R_6$ is hydrogen or an alkyl containing from 1 to 4, preferably 1 or 2 carbon atoms, $R_7$ is an alkyl containing from 12 to 24 carbon atoms, $R_8$ is an alkyl containing from 12 to 24 carbon atoms, $R_9$ is hydrogen or an alkyl containing from 1 to 4 carbon atoms and X is the salt counteranion, preferably a halide, methosulfate or ethosulfate. Preferred imidazolinium salts include 3-methyl-1-(tallowylamido)ethyl-2-tallowyl-4,5-dihydroimidazolinium methosulfate and 3-methyl-1-(palmitoylamido)ethyl-2-octadecyl-4,5-dihydroimidazolinium chloride. Other useful imidazolinium materials are 2-heptadecyl-3-methyl-1-(2-stearylamido)-ethyl-4,5-dihydroimidazolinium chloride and 2-lauryl- 3-hydroxyethyl-1-(oleylamido)ethyl-4,5-dihydro imidazolinium chloride. Also suitable herein are the imidazolinium fabric softening components of U.S. Pat. No. 4,127,489, incorporated herein by reference.

In the present invention, the water-insoluble cationic softener is present at a level of at least about 8%; below this level, there is generally no difficult in preparing products of conventional type with the necessary low viscosity at both normal and elevated temperatures. As the cationic softener level increases above 10%, the problems of viscosity control at higher temperatures become increasingly intractible. The overall aim, however, is to adjust the levels of softening, viscosity regulating and surfactant components within the prescribed limits to provide products which are stable to separation in a centrifuge at 3000 r.p.m. for 16 hours and which have a dynamic viscosity of less than about 350 cp (0.35 Pa.s), preferably less than about 150 cp (0.15 Pa.s) measured in a Brookfield Viscometer, using Spindle No. 2 at 60 r.p.m. and at 21° C. The maximum level of cationic softener in the present formulations is determined by practical considerations; thus, above a cationic softener level of 22% the problems of physical stability and product viscosity are such that it is not generally possible to formulate stable pourable dispersions based on water-insoluble cationic softener as the major softening component.

Preferred from the viewpoint of providing enhanced fabric softening benefits across the range of natural and synthetic fabrics with excellent viscosity and stability characteristics at both normal and elevated temperatures, are mixtures of the di-$C_{12}$–$C_{24}$ alkyl or alkenyl imidazolinium salts and the di-$C_{12}$–$C_{24}$ alkyl or alkenyl mono-ammonium salts in a weight ratio of at least 1:1 and at a total cationic softener level of from about 10% to about 20%. Highly preferred from this viewpoint is a cationic fabric softener comprising:

(i) a di-$C_{12}$–$C_{24}$ alkyl or alkenyl imidazolinium salt, and
(ii) a di-$C_{12}$–$C_{24}$ alkyl or alkenyl quaternary ammonium salt wherein the weight ratio of (i) to (ii) is from about 1:1 to about 6:1.

The cationic fabric softeners suitable for use herein desirably have a Krafft point (determined, for instance, using a polarizing microscope) of less than about 45° C. and display a lamellar liquid crystalline phase at temperatures immediately above the Krafft point. These phase characteristics are preferably determined at a cationic softener concentration of about 8% by weight.

The viscosity regulator system of the present compositions comprises a first component which is water-insoluble, contains a single long (about $C_{10}$–$C_{24}$) hydrocarbyl chain; and a second component which is a water-soluble cationic polymer having an average molecular weight in the range from about 2000 to about 250,000 containing an average of about 100 to 1000 monomer units per molecule and having a cationic charge density of at least 0.05 cations per monomer unit.

The first viscosity regulator component is selected generally from three classes of material, namely $C_{10}$–$C_{24}$ non-cyclic hydrocarbons, $C_{10}$–$C_{24}$ fatty acids or esters thereof with monohydric alcohols containing from 1 to 4 carbon atoms, and $C_{10}$–$C_{24}$ fatty alcohols, and preferably is present at less than about 40% of the cationic softener.

The first of the above classes of viscosity regulator agent is represented by non-cyclic hydrocarbons, optionally substituted by halogen atoms, having from 10 to 24, preferably from 14 to 22 carbon atoms.

Preferably, hydrocarbons useful in the present invention are paraffins or olefins, but other materials, such as alkynes and halo-paraffins, for example myristyl chloride or stearyl bromide, are not excluded. Materials known generally as paraffin oil, soft paraffin wax and petrolatum are especially suitable. Examples of specific materials are tetradecane, hexadecane, octadecane and octadecene. Preferred commercially-available paraffin mixtures include spindle oil and light oil and technical grade mixtures of $C_{14}/C_{18}$ n-paraffins and $C_{18}/C_{20}$ n-paraffins.

The second of the above classes of viscosity regulator agents is represented by materials of the general formula:

$$R_1COOR_2$$

wherein $R_1$ is a straight or branched chain alkyl or alkenyl group having from about 9 to about 23 carbon atoms and $R_2$ is hydrogen or an alkyl group having 1 to about 4 carbon atoms.

Highly preferred materials of this class are the $C_{10}$–$C_{20}$ saturated fatty acids, especially lauric acid, myristic acid, palmitic acid and stearic acid.

Esters of such acids with $C_1$–$C_4$ monohydric alcohols are also useful. Examples of such materials are methyl laurate, ethyl myristate, ethyl stearate, methyl palmitate and methyl oleate.

It will be appreciated that aqueous rinse-added fabric softening compositions are normally formulated at slightly acid pH and the fatty acids are believed to be present in the composition in their acid form and not in the form of soaps.

The third of the above classes of viscosity regulator agent is represented by fatty alcohols, that is by compounds of the general formula:

$$R_3OH$$

wherein $R_3$ is a straight or branched chain alkyl or alkenyl group having from about 10 to about 24, especially from about 12 to about 16 carbon atoms. Specific examples of this class are decanol, dodecanol, tetradecanol, pentadecanol, hexadecanol and octadecanol. The most preferred materials are lauryl and palmityl alcohols.

These alcohols can be prepared by hydrogenation of the naturally occurring fatty acids or by any of the well-known synthetic routes, such as the oxo-process which results in primary alcohols having about 25% chain branching, predominantly short chain branching.

The second viscosity regulator component is a water-soluble cationic polymer having an average molecular weight in the range from about 2000 to 250,000, preferably from about 5000 to 150,000 and contains an average of from about 100 to about 1000, preferably from about 150 to 700 monomer units per molecule. Molecular weights are specified as viscosity average molecular weights and can be determined as described in F. Daniels et al Experimental Physical Chemistry, pp 71–74, 242–246, McGraw-Hill (1949), at 25° C. using an Ostwald viscometer. The polymers are preferably soluble in distilled water to the extent of 0.5% by weight at 20° C.

The preferred cationic polymers are all based on polyethylenimine, the structural formula of which is believed to be:

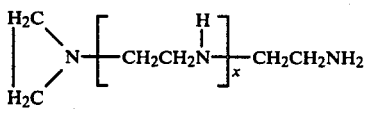

wherein x represents a whole number of sufficient magnitude to yield a polymer of molecular weight greater than about 2000. Branch chains occur along the polymeric backbone and the relative proportions of primary, secondary and tertiary amino groups present in the polymer will vary, depending on the manner of preparation. The distribution of amino groups in a typical polyethylenimine is approximately as follows:

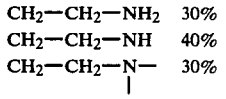

The polyethylenimine is characterized herein in terms of molecular weight. Such polymers can be prepared, for example, by polymerizing ethylenimine in the presence of a catalyst such as carbon dioxide, sodium bisulfite, sulfuric acid, hydrogen peroxide, hydrochloric acid, acetic acid, etc. Specific methods are described in U.S. Pat. Nos. 2,182,306, Ulrich et al., granted Dec. 5, 1939; 3,033,746, Mayle et al., granted May 8th, 1962; 2,208,095, Esselmann et al., granted July 16, 1940; 2,806,839, Crowther, granted Sept. 17, 1957 and 2,553,696, Wilson, granted May 21, 1951. Polyethylenimine has a cationic charge density of about 0.17 cations/monomer in aqueous solution at pH 7.0 and preferably has an average molecular weight of from about 10000 to about 35000.

Similarly, alkoxylated polyethylenimine can be prepared, for example, by reacting one part by weight ethylene oxide or propylene oxide with one part by weight of polyethylenimine prepared as described above and having a molecular weight greater than about 2000. Preferably the weight ratio of polyethylenimine to alkylene oxide is at least about 1:1. A preferred ethoxylated polyethylenimine has a molecular weight of about 20000 to about 70000 and a cationic charge density of about 0.17 cations/monomer in aqueous solution at pH 7.0.

Other suitable cationic polymeric salts are quaternized polyethylenimines, having molecular weights from about 40000 to about 100000, i.e. polymers comprising the repeating unit:

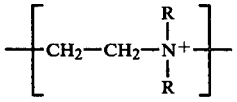

wherein R is $C_1$–$C_{20}$ alkyl or benzyl. Commercial examples of polymers of this type include those sold under the Trade Name Alcostat by Allied Colloids.

It will be appreciated by those skilled in the art that quaternization reactions do not easily go to completion and usually a degree of substitution up to about 60% of the available nitrogen is achieved and is quite effective. Thus, it should be understood that usually only a proportion of the units constructing the cationic polymer have the indicated structure.

A preferred, though optional component of the present compositions is a water-soluble surfactant, especially a cationic or nonionic surfactant having a solubility in distilled water at pH 2.5 and 20° C. of greater than about 1 g/l. Once again, the solubility of the cationic surfactant is defined with reference to the pure material in the form of a strong acid salt (e.g. chloride), and the soluble fraction of the surfactant is taken to be that material which cannot be separated from water by centrifugal action and which passes a 100 nm Nuclepore filter.

Preferred water-soluble cationic surfactants are mono-$C_8$–$C_{24}$ alkyl or alkenyl ammonium salts, imidazolinium salts, pyridinium salts and mixtures thereof.

Suitable water-soluble mono-ammonium compounds have the general formula:

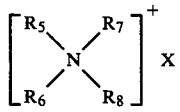

wherein $R_5$ represents a $C_8$–$C_{24}$ alkyl or alkenyl group, $R_6$ represents hydrogen, a $C_1$–$C_{12}$ alkyl, alkenyl or hydroxyalkyl group, an aryl group, a $C_{1-6}$ alkylaryl group, or a poly(ethylene oxide) group having from 2 to 20 ethylene oxide units, $R_7$, $R_8$ individually represent hydrogen, a $C_1$–$C_4$ alkyl, alkenyl or hydroxyalkyl group or a poly(ethylene oxide) group having from 2 to 20 ethylene oxide units and X is as defined above.

Highly preferred materials of this general type include the tallow trimethyl ammonium salts, cetyl trimethyl ammonium salts, myristyl trimethyl ammonium salts, coconutalkyl trimethyl ammonium salts, stearyl dimethyl ammonium salts, cetyl dimethyl ammonium salts, myristyl dimethyl ammonium salts, coconutalkyl dimethyl ammonium salts, oleyl methyl ammonium salts, palmityl methyl ammonium salts, myristyl methyl ammonium salts, lauryl methyl ammonium salts, dodecyl dimethyl hydroxyethyl ammonium salts, dodecyl dimethyl hydroxypropyl ammonium salts, myristyl dimethyl hydroxyethyl ammonium salts, dodecyl dimethyl dioxyethylenyl ammonium salts, myristyl benzyl hydroxyethyl methyl ammonium salts, coconutalkyl benzyl hydroxyethyl methyl ammonium salts, dodecyl dihydroxyethyl methyl ammonium salts, cetyl dihydroxyethyl methyl ammonium salts, and stearyl dihydroxyethyl methyl ammonium salts.

Highly preferred water-soluble imidazolinium materials are represented by the general formula

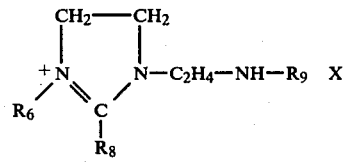

or acids salts thereof, wherein $R_6$, $R_7$, $R_8$, $R_9$ and X were defined earlier. Preferred imidazolinium salts of this general formula include the compound in which $R_6$ is methyl, $R_8$ is tallowyl and $R_9$ is hydrogen and the compound in which $R_6$ is methyl, $R_8$ is palmitoyl and $R_9$ is hydrogen.

Highly preferred water-soluble polyammonium cation materials are represented by the general formula:

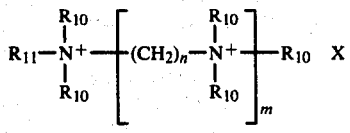

wherein $R_{11}$ is selected from an alkyl or alkenyl group having from 12 to 24, preferably from 16 to 20 carbon atoms in the alk(en)yl chain, $R_{11}CO$— and $R_{11}$—O—$(CH_2)_n$—; each $R_{10}$ is independently selected from hydrogen, —$(C_2H_4O)_pH$, —$(C_3H_6O)_qH$, —$(C_2H_4O)_r(C_3H_6O)_sH$, a $C_{1-3}$ alkyl group and the group —$(CH_2)_n$—N(R')$_2$, wherein R' is selected from hydrogen, —$(C_2H_4O)_pH$, —$(C_2H_4O)_pH$, —$(C_2H_4O)_p(C_3H_6O)_qH$ and $C_{1-3}$ alkyl; n is an integer from 2 to 6, preferably 2 or 3; m is an integer from 1 to 5, preferably 1 or 2; p,q,r and s are each a number such that the total p+q+r+s in the molecule does not exceed 25 (preferably, each p and q is 1 or 2 and each r and s is 1); and X represents one or more anions having total charge balancing that of the nitrogen atoms.

Preferred water-soluble cationic materials are alkoxylated and contain not more than one —$C_2H_4OH$ or —$C_3H_6OH$ group attached to each nitrogen atom, except that up to two of these groups can be attached to a terminal nitrogen atom which is not substituted by an alkyl group having from 10 to 24 carbon atoms.

Polyamine species suitable for use herein include:

N-tallowyl,N,N',N'-tris(2-hydroxyethyl)1,3-propanediamine di-hydrochloride or dibenzoate;

N-soybean alkyl 1,3-propane diammonium sulfate;

N-stearyl,N,N'-di(2-hydroxyethyl)-N'-(3-hydroxypropyl)-1,3-propanediamine dihydrofloride;

N-cocoyl N,N,N',N',N'-pentamethyl-1,3-propane diammonium dichloride or di-methosulfate;

N-oleyl N,N',N'-tris (3-hydroxypropyl)-1,3-propanediamine dihydrofluoride;

N-stearyl N,N',N'-tris(2-hydroxyethyl) N,N'-dimethyl-1,3-propanediammonium dimethylsulfate;

N-palmityl N,N',N'-tris(3-hydroxypropyl)-1,3-propanediamine dihydrobromide;

N-(stearyloxypropyl) N,N',N'-tris(3-hydroxypropyl)1,3-propanediammonium diacetate;

N-tallowyl N-(3-aminopropyl)1,3-propanediamine trihydrochloride;

N-oleyl N-[N'',N'' bis(2-hydroxyethyl)3-aminopropyl]N',N'-bis(2-hydroxyethyl)1,3 diaminopropane trihydrofluoride;

N-tallowyl diethylene triamine trihydrochloride.

The water-soluble cationic surfactant herein can also be represented by alkyl pyridinium salts having the following formula:

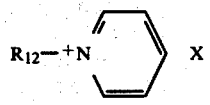

wherein $R_{12}$ is a $C_{10}$–$C_{24}$, preferably $C_{16}$ or $C_{18}$ alkyl radical and X is a suitable anion as defined hereinbefore, preferably a halide, especially chloride or bromide.

It should be understood, of course, that water-soluble cationic surfactants of the amine-salt class can be added in the form of the neutral amine followed by pH adjustment to within the range from about pH 4 to about pH 8.

In addition to the above-mentioned components, the compositions may contain other textile treatment or conditioning agents. Such agents include silicones, as for example described in German patent application DOS 26 31 419 incorporated herein by reference.

The optional silicone component can be used in an amount of from about 0.1% to about 6%, preferably from 0.5% to 2% of the softener composition.

A further optional component of the present composition is a fatty acid ester of a polyhydric alcohol, for instance a $C_{12}$–$C_{22}$ fatty acid ester of ethylene glycol, propylene glycol, glycerol, diglyerol, xylitol, sucrose, erthrytol, pentaerthritol, sorbitol or sorbitan. These esters, specific examples of which include ethyleneglycol monostearate, propyleneglycol monostearate, glyceryl monostearate and glyceryl distearate, can provide an additional softening facility. However, in as much as such fatty acid esters can have a deleterious effect on product viscosity, it is preferred to include them, if at all, only at low levels (<2%).

The compositions herein can contain other optional ingredients which are known to be suitable for use in textile softeners at usual levels for their known functions. Such adjuvants include emulsifiers, perfumes, preservatives, germicides, colorants, dyes, fungicides, stabilizers, brighteners and opacifiers. These adjuvants, if used, are normally added at their conventional low levels.

The composition of the invention can also comprise additional viscosity control agents, such as 1% to 10% of lower alcohols, especially ethanol and isopropanol, and electrolytes, for example calcium chloride, at levels of from 100 to 1000 ppm. It is a feature of the invention, however, that such materials can be reduced or eliminated completely from the instant compositions.

The compositions can normally be prepared by mixing the ingredients together in water, heating to a temperature of about 60° C. and agitating for 5–30 minutes.

The pH of the compositions is generally adjusted to be in the range from about 3 to about 8, preferably from about 4 to about 6. In this preferred pH range, it will be understood that the neutralization of amines or polyamines in the composition can be incomplete.

When compositions of the present invention are added to the rinse liquor, a concentration from about 10 ppm to 1000 ppm, preferably from about 50 ppm to about 500 ppm, of total active ingredient is appropriate.

The following examples illustrate the invention. In the Examples, the following abbreviations are used:

| | |
|---|---|
| Ditallow dimethyl ammonium chloride | DTDMAC |
| 3-methyl-1-(2-tallowylamido)ethyl-2-tallowyl-4,5-dihydroimidazolinium methosulphate | MDTIM |
| Di(2-tallowylamido)ethyl methyl ammonium chloride | DTEMAC |
| Tallow trimethyl ammonium chloride | MTTMAC |
| 3-methyl-1-(2-amino)ethyl-2-tallowyl-4,5-dihydroimidazolinium methosulphate | MMTIM |
| 1-(2-amino)ethyl-2-tallowyl-4,5-dihydroimidazolinium methosulphate | MTIM |
| Tallow dimethyl ammonium chloride | MTDMAC |
| N—tallowyl-N,N',N'—tris(2-hydroxyethyl)-1,3-propane diamine | MTHPD |
| Polyethylenimine having a molecular weight from about 10,000 to about 30,000 marketed | |

-continued

| | |
|---|---|
| by BASF, under Trade Name Polyamin P | PEI |
| Ethoxylated polyethylenimine having a weight ratio of polyethylenimine to ethylene oxide of about 1.3:1 and a molecular weight of about 60,000 | EOPEI |
| Quaternized polyethylenimine salt, marketed by Allied Colloids | Alcostat C |

EXAMPLES I TO VII

Concentrated liquid fabric softeners were prepared having the compositions indicated below, by dispersing the active ingredients in water at about 55° C. and trimming with hydrochloric acid to a pH of 5.0.

| | I | II | III | IV | V | VI | VII |
|---|---|---|---|---|---|---|---|
| DTDMAC | 4 | 12 | — | 2 | 6 | — | 2 |
| MDTIM | 6.5 | — | 9.5 | 2 | 11 | 12 | — |
| DTEMAC | 1.5 | — | — | 8 | 2.5 | — | — |
| MTTMAC | — | 0.5 | — | — | — | — | — |
| MMTIM | 1.5 | — | — | — | 3 | 0.5 | — |
| MTIM | 0.5 | — | — | — | — | — | 2 |
| MTDMAC | — | — | — | 2 | — | — | — |
| MTHPD | — | — | 1 | — | — | — | — |
| PEI | — | 0.5 | — | 0.3 | — | — | — |
| EOPEI | 0.2 | — | — | — | 0.4 | — | 0.1 |
| Alcostat C | — | — | 0.1 | — | — | 0.2 | 0.1 |
| $C_{14}$–$C_{17}$ technical paraffin | — | 2 | — | — | — | — | 2 |
| Octadecane | — | — | 1 | — | — | — | — |
| $C_{18}$–$C_{20}$ n-paraffins | 4 | — | — | — | — | — | — |
| Stearic acid | — | — | — | 2 | — | — | — |
| Undecanol | — | — | — | — | 5 | — | 2 |
| Isobutylstearate | — | — | — | — | — | 4 | — |
| Calcium chloride (ppm) | 400 | 250 | 200 | 300 | 500 | 350 | 250 |
| Water, perfume and minors | | | | To 100 | | | |

The above compositions displayed excellent softening characteristics on both natural and synthetic fabrics, low viscosity at both normal and elevated temperatures, and good product stability and dispersibility, compared with compositions containing no polymeric cationic salt.

What is claimed is:

1. A liquid farbic softening composition in the form of a dispersion in aqueous isotropic medium comprising:

(a) from 8% to 22% of water-insoluble cationic fabric softener, and (b) a viscosity regulator system comprising:

(i) from 0.5% to 6% of a first regulator component selected from $C_{10}$–$C_{24}$ non-cyclic hydrocarbons, $C_{10}$–$C_{24}$ fatty acids or esters thereof with monohydric alcohols containing from 1 to 4 carbon atoms, $C_{10}$–$C_{24}$ fatty alcohols, and mixtures thereof, and (ii) from 0.05% to 1.0% of a second regulator component which is a water-soluble cationic polymer having an average molecular weight in the range from 2000 to 250,000 selected from polyethylenimine, the reaction product of polyethylenimine with ethylene oxide, propylene oxide or both in a weight ratio of greater than 1:4, and the $C_1$–$C_{20}$ alkyl and benzyl quaternization products of polyethylenimine and of said reaction product of polyethylenimine and mixtures thereof.

2. A composition according to claim 1 wherein the cationic fabric softener is selected from:

(a) di-$C_{12}$–$C_{24}$ alkyl and alkenyl mono- and polyammonium salts, (b) di-$C_{12}$–$C_{24}$ alkyl and alkenyl imidazolinium salts, and (c) mixtures thereof.

3. A composition according to claim 2 wherein the cationic fabric softener is a mixture of di-$C_{12}$–$C_{24}$ alkyl or alkenyl imidazolinium salt and di-$C_{12}$–$C_{24}$ alkyl or alkenyl mono-ammonium salt in a weight ratio of at least 1:1 and a total level of from 10% to 20%,

4. A composition according to claim 1 wherein the first viscosity regulator component is selected from $C_{14}$–$C_{22}$ linear and branched paraffins, $C_{10}$–$C_{20}$ fatty acids and $C_{12}$–$C_{16}$ fatty alcohols.

5. A composition according to claim 1 wherein the second viscosity regulator component has an average molecular weight in the range from 5,000 to 150,000 and is selected from polyethylenimine, the reaction product of polyethylenimine with ethylene oxide at weight ratio of from 1:1 to 4:1 and $C_1$–$C_{20}$ alkyl or benzyl quaternization products of polyethylenimine.

6. A composition according to any of claims 1, 4 or 5 wherein the viscosity regulator system comprises from 2% to 5% of said first regulator component and from 0.1% to 0.5% of said second regulator component.

7. A composition according to claim 1 additionally containing a water-soluble cationic or nonionic surfactant or mixture thereof, the weight ratio of cationic fabric softener to water-soluble cationic or nonionic surfactant lying in the range from 100:1 to 5:2.

8. A composition according to claim 7 wherein the water-soluble cationic surfactant is selected from:

(a) mono-$C_8$–$C_{24}$ alkyl and alkenyl mono- and polyammonium salts, (b) mono-$C_8$–$C_{24}$ alkyl and alkenyl imidazolinium salts, (c) mono-$C_8$–$C_{24}$ alkyl and alkenyl pyridinium salts, and (d) mixtures thereof.

9. A composition according to claim 1 wherein the cationic fabric softener has a Krafft point of less than 45° C. at a concentration of 8% and displays a lamellar crystalline phase at temperatures immediately above the Krafft point.

10. A composition according to claim 1 comprising:

(a) from 2% to 5% of said first viscosity regulator component selected from $C_{14}$–$C_{22}$ linear or branched paraffins, $C_{10}$–$C_{20}$ fatty acids and $C_{12}$–$C_{16}$ fatty alcohols, and mixtures thereof, and (b) from 0.1% to 0.5% of said second regulator components selected from polyethylenimine having an average molecular weight of from 10,000 to 35,000, the reaction product of polyethylenimine with ethylene oxide at a weight ratio of from 1:1 to 4:1, said reaction product having an average molecular weight of from 20,000 to 70,000, $C_1$–$C_{20}$ alkyl and benzyl quaternization products of polyethylenimine, said quaternization products having an average molecular weight of from 40,000 to 100,000, and mixtures thereof.

11. A liquid softening composition as recited in claim 1, in which the water-insoluble cationic softener is selected from the group consisting of di-$C_{12}$–$C_{24}$ alkyl and alkenyl monoammonium salts, di-$C_{12}$–$C_{24}$ alkyl and alkenyl imidazolinium salts, and mixtures thereof, in which the first regulator component is selected from the group consisting of $C_{14}$–$C_{22}$ linear and branched paraffins and mixtures thereof, and in which the second regulator component is selected from the group consisting of polyethylenimine having an average molecular weight of from about 10,000 to about 35,000, ethoxylated polyethylenimine having a weight ratio of polyethylenimine to ethylene oxide of from about 1:1 to about 4:1 and a molecular weight ranging from about 20,000 to about 70,000, $C_1$–$C_{20}$ alkyl or benzyl quaternization products of polyethylenimine and mixtures thereof.

12. A liquid softening composition as recited in claim 11, in which the water-insoluble cationic softener is a mixture of the di-$C_{12}$–$C_{24}$ alkyl or alkenyl imidazolinium salts and the di-$C_{12}$–$C_{24}$ alkyl or alkenyl monoammonium salts in a weight ratio of from about 1.5:1 to about 6:1 and at a total water-insoluble cationic softener level of from about 10% to about 20%, in which the first regulator component is present in an amount ranging from about 2% to about 5% and in which the second regulator component is present in an amount ranging from about 0.1% to about 0.5%.

13. A liquid softening composition as recited in claim 1, in which the first regulator component is selected from the group consisting of $C_{10}$–$C_{24}$ fatty acids, $C_{10}$–$C_{24}$ fatty alcohols, and mixtures thereof.

* * * * *

UNITED STATES PATENT AND TRADEMARK OFFICE

CERTIFICATE OF CORRECTION

PATENT NO. : 4,386,000

DATED : May 31, 1983

INVENTOR(S) : John C. Turner et al

It is certified that error appears in the above-identified patent and that said Letters Patent are hereby corrected as shown below:

ON THE TITLE PAGE,

The priority date should be July 5, 1980.

Signed and Sealed this

*Second* Day of *August 1983*

[SEAL]

*Attest:*

GERALD J. MOSSINGHOFF

*Attesting Officer*

*Commissioner of Patents and Trademarks*